US007836846B2

(12) United States Patent
Mikalsen et al.

(10) Patent No.: US 7,836,846 B2
(45) Date of Patent: Nov. 23, 2010

(54) PAINT DOSAGE DEVICE AND SYSTEM

(75) Inventors: Kenneth Mikalsen, Bryne (NO); Steffen Georgi, Plauen (DE); Olav Fatland, Bryne (NO)

(73) Assignee: ABB AS (NO)

( * ) Notice: Subject to any disclaimer, the term of this patent is extended or adjusted under 35 U.S.C. 154(b) by 150 days.

(21) Appl. No.: 12/098,889

(22) Filed: Apr. 7, 2008

(65) Prior Publication Data

US 2008/0226832 A1 Sep. 18, 2008

Related U.S. Application Data

(63) Continuation of application No. PCT/IB2006/053688, filed on Oct. 9, 2006.

(60) Provisional application No. 60/724,960, filed on Oct. 7, 2005.

(51) Int. Cl.
*B05C 5/02* (2006.01)

(52) U.S. Cl. ..... 118/621; 239/690

(58) Field of Classification Search ..... 118/621–640; 239/690

See application file for complete search history.

(56) References Cited

U.S. PATENT DOCUMENTS

| | | | | |
|---|---|---|---|---|
| 4,785,760 | A | 11/1988 | Tholome | 118/323 |
| 5,310,120 | A * | 5/1994 | Ehinger et al. | 239/708 |
| 5,630,552 | A | 5/1997 | Anfindsen et al. | 239/708 |
| 5,861,060 | A | 1/1999 | Maugans et al. | 118/50 |
| 2004/0115360 | A1 * | 6/2004 | Clifford et al. | 427/421 |
| 2006/0124769 | A1 * | 6/2006 | D'Andreta | 239/300 |

FOREIGN PATENT DOCUMENTS

| | | |
|---|---|---|
| EP | 0 031 649 | 7/1981 |
| EP | 0 441 501 | 8/1991 |
| EP | 0 602 434 | 6/1994 |
| WO | 2006/032943 | 3/2006 |

OTHER PUBLICATIONS

International Search Report, Feb. 2, 2007, 6 pages.
Written Opinion, Feb. 5, 2007, 5 pages.

* cited by examiner

*Primary Examiner*—Parviz Hassanzadeh
*Assistant Examiner*—Albert Hilton
(74) *Attorney, Agent, or Firm*—St. Onge Steward Johnston & Reens LLC

(57) ABSTRACT

An insulation cover for a high voltage paint dosing apparatus, the apparatus comprising a docking head arranged to receive at least one dosing cylinder filled with paint for dosing to an applicator or gun. The docking head is arranged substantially-surrounded by the insulation cover and whereby the external surface of the insulation cover is partly covered by a conductive or non-insulating layer. A system comprising the paint dosing apparatus with the insulation cover is also described.

23 Claims, 3 Drawing Sheets

PAINT DOSAGE DEVICE AND SYSTEM

CROSS-REFERENCE TO RELATED APPLICATIONS

The present application is a continuation of pending International patent application PCT/IB2006/053688 filed on Oct. 9, 2006 which designates the United States and claims priority from U.S. provisional patent application 60/724,960 filed on Oct. 7, 2005, the content of which is incorporated herein by reference.

FIELD OF THE INVENTION

The invention concerns a device for a spray painting apparatus adapted for dosing electrically conductive fluid materials to a spray gun/applicator. In particular the invention is an insulation cover for part of a spray gun/applicator and or a painting system containing same in which a high voltage is applied for the purpose of electrostatically charged atomizing of electrically conductive fluid materials.

BACKGROUND OF THE INVENTION

The present invention is related to a paint dosage device for use in spray painting installation, a program controlled The paint dosage device provides for a dosed paint supply to the applicator or spray gun, and in particular for the case in which the applicator is provided with high tension electrode for electrical atomizing of the supplied electrically conductive paint. In addition the paint dosing apparatus must also be well insulated, explosion-proof and reliable, without being excessively difficult or expensive to implement. Application with direct charge of conductive or water borne paints requires an effective insulation or galvanic blocking between a spray gun/applicator charged with a high voltage and apparatus at zero or ground potential, in particular a paint dosing device and/or the paint lines supplying the dosing device.

U.S. Pat. No. 5,630,552, (Anfindsen) entitled Paint dosage device for program controlled spray painting system, describes a spray painting installation particularly suitable for the application of electrostatically atomized paint. The dosage device of the installation comprises dosing cylinders. Each dosage cylinder has a regulating piston, respectively, and regulation members for controlling the position and displacement velocity of the regulating pistons in the dosing cylinders. The dosing cylinders also have a controlled valve assembly and connection means for connecting the cylinders alternately to the spray gun and for connecting the cylinder when disconnected from the gun in connection with means for cleansing and refilling of paint. The dosage device described may be mounted in close proximity to a spray gun on a robot arm, it provides accurate dosing of fluid materials (paint) and it is insulated from the paint supply lines.

An international patent application WO IB2004/003104 (Anfindsen et al), assigned to ABB, which is hereby incorporated in full by means of this reference, describes an improved spray painting system with a dosing device. In particular it describes means for achieving a galvanic block, or voltage block, between the dosed fluid in contact with a high voltage and the fluid in the supply lines or paint kitchen etc which is normally at ground potential. In this description a dosing device is described which comprises one or more dosing cylinders which may be filled at a paint supply point, moved away from the supply point and towards a spray head connection point, and there connected to one or more spray heads. An insulation cover is described which is arranged surrounding a docking head in the region of the connection point between the valve block for the spray head and a dosing cylinder. The cover is arranged such that as a dosing device is moved forward into the housing a galvanic contact is made by a charging antennae which may be a single electrode, scraper or a brush, before the valves of the dosing device make contact with the valves of the docking head.

SUMMARY OF THE INVENTION

An embodiment of the present invention provides an improved insulation cover for a paint dosing apparatus, maintained at a high voltage, comprising an insulation cover which surrounds a high voltage part of the paint dosing apparatus. Another embodiment of the present invention provides an improvement to an insulation cover in the form of a cover made from an insulating material which is coated on at least part of the external surface with a conductive layer.

Another embodiment of the present invention provides an improved insulation cover for a paint dosing apparatus, maintained at a high voltage, comprising an insulation cover which surrounds a high voltage part of the paint dosing apparatus and which is coated externally with a conductive coating or non-insulating layer at least in part.

According to another embodiment of the present invention an improvement is provided in the form of an improved insulation cover for a paint application wherein the external surface of the insulation cover is partly covered by a conductive coating or non-insulating layer which is connected to a ground or earth terminal. Another embodiment of the present invention provides an improvement wherein the external surface of the insulation cover is partly covered by a conductive or non-insulating layer comprising a metallised layer, or a conductive paint, or a conductive composite material which is connected to a ground or earth terminal.

According to another embodiment an improvement is provided whereby a conductive or non-insulating layer is applied to the inside surface of the insulation cover in an area around a connection or mating line where a part of the docking head is mated in an aperture of the insulation cover.

According to another aspect of the invention a system is provided for applying paint or other fluid materials to a substrate comprising at least one robot which is equipped with a paint application apparatus maintained in part at a high voltage comprising an improved insulation cover which comprises an external surface of the insulation cover which is partly covered by a conductive coating or non-insulating layer, which is further connected to a ground or earth terminal.

According to another embodiment of the invention an improved system for applying paint or other fluid materials to a substrate is provided wherein an improved insulation cover is provided which comprises a flushing device or reservoir connectable to the docking head.

The invention may be summarily described as comprising an insulating cover for a paint dosing apparatus, of the type of paint apparatus that is maintained at a high voltage. Application and spraying of conductive materials such as waterborne paint and other conductive fluids is carried out using painting equipment maintained at a high voltage of up to 120 Kv or more. The paint dosing apparatus comprises a docking head arranged to receive at least one container filled with paint for dosing to an applicator or gun. The insulating cover of the present invention insulates parts of a paint dosing apparatus in a direct charge high voltage painting system from surroundings maintained at zero or earth potential. In particular the insulation cover is made from an insulating material in order to insulate the docking head of the paint dosing apparatus and dosing cylinders when connected to the docking head from surroundings or apparatus at ground or zero potential. The dosing cylinders are each first connected to the docking head as a full cylinder and subsequently disconnected from the docking head for re-filling when empty. During painting or application operations at high voltage, static electricity builds up over time on the external surface of the insulation cover. To eliminate this, the outside surface of the cover surface is covered with a conductive material, which is grounded to a point at zero or ground potential.

The principal advantage of the improved insulation cover is that the paint dosing apparatus is protected against build-up on and/or discharges of static electricity from the cover around the docking head and dosing cylinders. This allows free movement of dosing cylinders to and from the docking head connection point for the main valve block connected to the applicator, so enabling a continuous supply of dosed paint or other fluid while maintaining a robust voltage block between the docking head and the surroundings.

Another advantage of the improved insulation cover is that it protects nearby paint lines, connected to other main paint handling systems, or a paint kitchen, from the possible effects of voltage leakage from parts, principally the applicator, that are operated at a high voltage. This provides a robust device and system for painting and coating that may also be operated in a flexible way with full freedom to include paint changes, colour changes and/or flushing sequences efficiently and often without interrupting paint or coating production.

Another advantage of the improved insulation cover according to an embodiment of the invention is that production and manufacture of the insulation cover may be carried out in an efficient and economic manner. The insulation cover may be manufactured as a single shape moulded from a suitable insulating plastic material. A similar conductive coating to the conductive coating applied on the external surface may also more or less at the same time be applied to a part of the internal surface, especially around an aperture where the docking head is mated into the insulation cover. The application of a conductive coating avoids build up of static charge at edges or points in the area of the join between the material of the insulation cover and the docking head or valve block, which are often made of a metal.

Another advantage of the improved insulation cover according to an embodiment of the invention is that flushing operations are facilitated by arranging a flushing reservoir inside the insulation cover. The arrangement of a flushing reservoir inside the insulation cover facilitates the application of spray paint or other coatings on objects which require coating with a large volume of paint and/or are arranged close to each other, without having to interrupt the coating process for cleaning processes.

BRIEF DESCRIPTION OF THE DRAWINGS

The invention will now be further explained by means of exemplary embodiments and with reference to the accompanying drawings, of which.

DETAILED DESCRIPTION OF THE INVENTION

The insulation cover according to an embodiment of the invention is used to insulate part of a paint supply apparatus in a direct charge high voltage painting system. Application and spraying of conductive materials such as waterborne paint and other conductive fluids, may applied in a high voltage paint system where parts of the system are at 150 kV or more.

Figure 1:
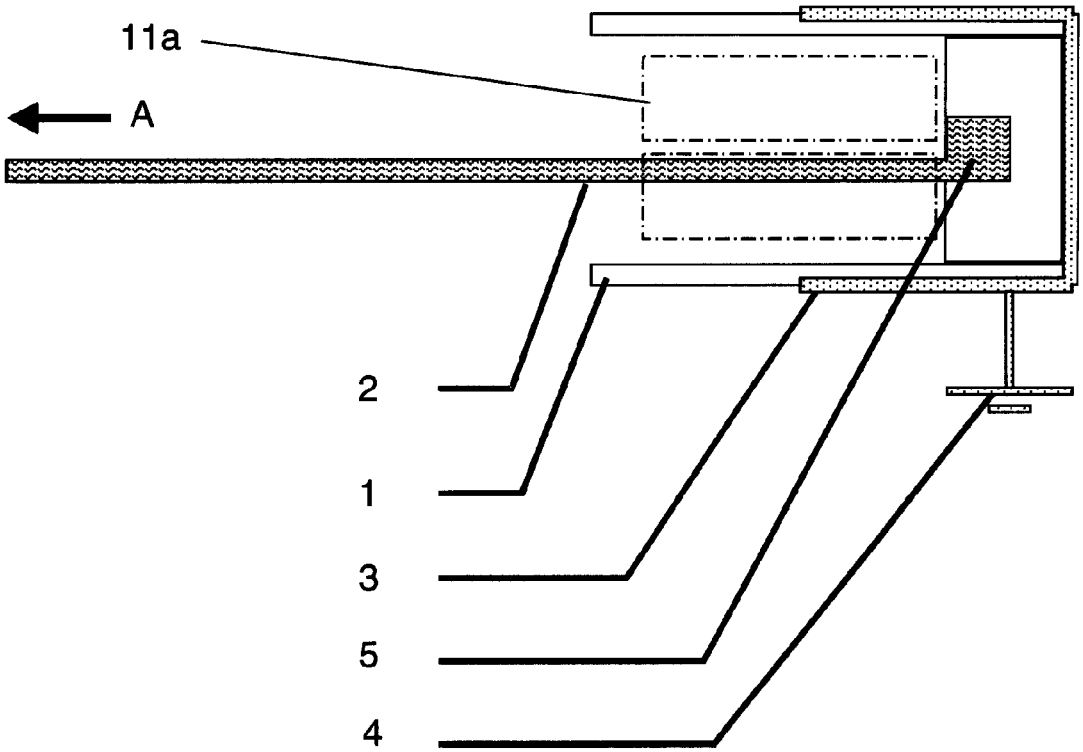
FIG. 1 shows a view of a schematic diagram for a paint spraying apparatus with an improved insulating cover according to an embodiment of the invention.

An improved insulating cover according to an embodiment of the invention is shown schematically in a cross section in FIG. 1. The figure shows a cover 1 made from a non-conductive material such as a suitable plastic. The insulating cover is covered in part by a conductive layer 3, indicated by a cross section with a pattern of dots. Conductive layer 3 is connected to a zero potential or ground 4.

The figure shows a hose 2 running from the docking head 5 out through the open end of the insulation cover, in direction A. The hose is flexible and insulated against high voltage. It is connected at one end to the docking head 5 and is connected at the other end to a spray gun or applicator. The hose 2 and the docking head 5 are drawn in cross section and marked with a pattern of short lines to indicate a fluid.

FIG. 1 also shows the position of two dosing cylinders, one or them indicated with the number 11*a*, in position inside the insulation cover and connected to the docking head.

During operation at high voltage static electricity builds up on the surface of the insulating cover 1 and a static charge tends to accumulate. This static charge is eliminated according to an embodiment of the invention by grounding part of the surface of the cover. This is done by arranging insulating cover with a conductive layer or coating 3 which is grounded by being galvanically connected to ground 4. The external conducting or non-insulating coating may comprise a metallised layer. Another non-insulating material such as a conductive paint, a conductive or semi-conducting metal or plastic or a composite may be substituted for the metallised layer. Such a layer may comprise a polymeric material such as a polyolefin, cross-linked polymer or rubber or other suitable plastic material which is loaded with a conductive form of carbon particles to achieve a semiconducting or near conducting layer.

Figure 2:
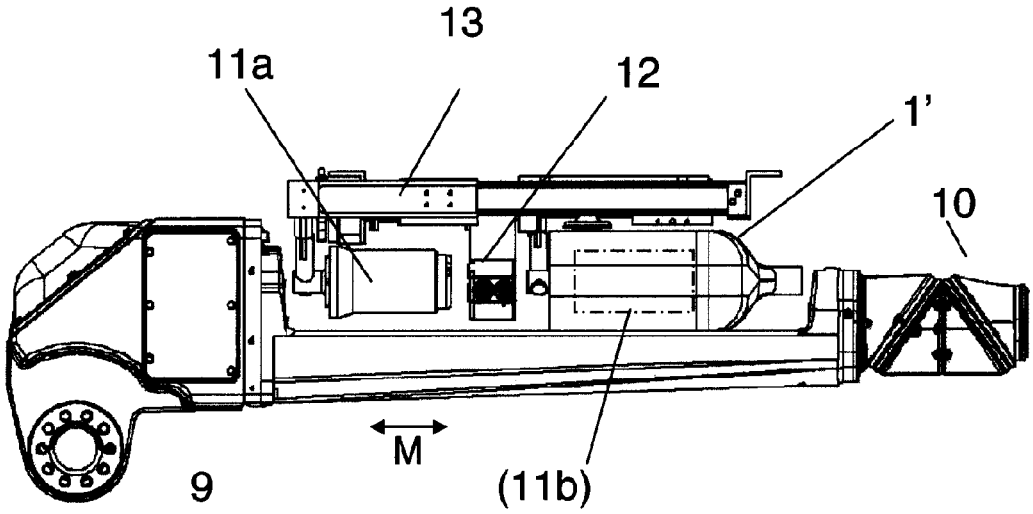
FIG. 2 shows a view of a paint spraying apparatus arranged on a robot arm comprising an insulating cover according to an embodiment of the invention.

FIG. 2 shows a schematic and simplified view of a paint dosing apparatus including an insulation cover according to another embodiment of the invention arranged on a robot arm 9. A robot wrist 10 may be seen mounted on the front end of a robot arm 9. Mounting the one or more spray gun/applicators on a robot wrist gives greater flexibility to a coating or paint-spraying process. The figure also shows one first dosing cylinder 11*a* and a second dosing cylinder lib is indicated as a rectangle with dashed lines to show the position taken by the dosing cylinder lib as arranged inside the insulation cover 1. Both the dosing cylinder lib and the docking head or front valve block are inside the insulation cover in this view.

Figure 3A:
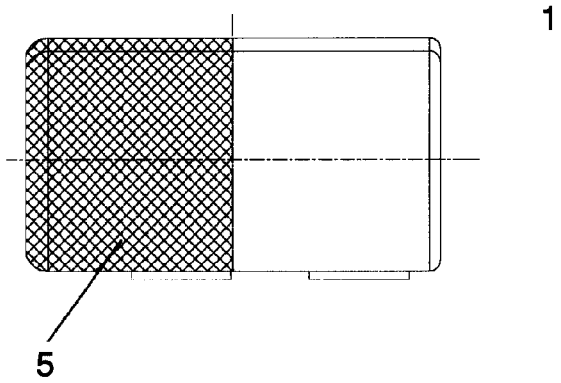
FIGS. 3*a-c* show a sectional view of an insulation cover from one side, a view of the interior of the cover, and a view from the top of an insulating cover according to an embodiment of the invention.
Figure 3B:
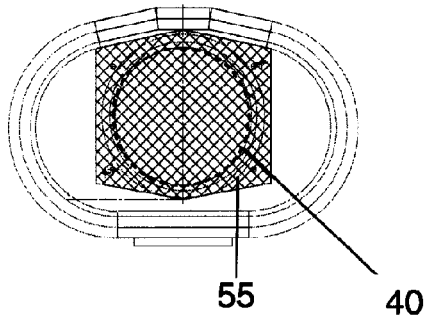
Figure 3C:
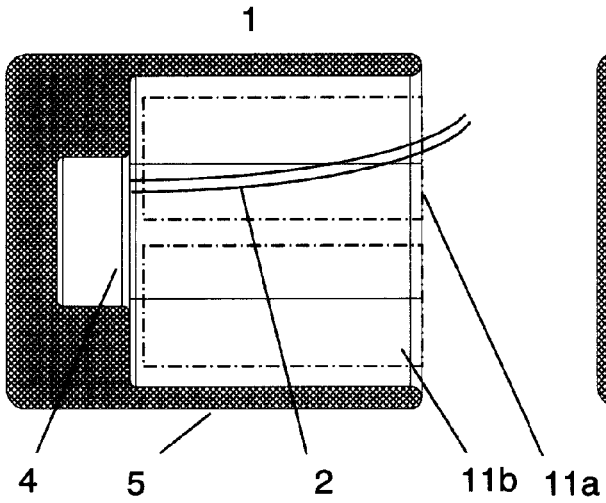

FIG. 3*a* shows a side view of an insulation cover 1 according to an embodiment of the invention which is arranged with a large opening at the right side of the figure. A coating 3 is indicated by cross-hatching over part of the external surface. FIG. 3 *b* shows a view of the insulation cover 1 as seen looking into the opening of the cover. At the closed end of the cover an aperture 40 has been formed in which is arranged the docking head with connection points for two dosing cylinders (not shown in this view). On the inside surface of the insulation cover around the vicinity of the aperture for receiving the docking head, the inside surface is covered with a conductive coating 55, as indicated by the cross-hatching. FIG. 3*c* shows a view of the insulation cover from above and in part in a cross sectional view. The figure shows the cover 1 and revealing in cross section the docking head 5 depicted in FIG. 3*c* as a space containing a volume of paint. The positions taken inside the insulation cover by dosing cylinders when connected to the docking head are indicated by rectangles lib, 11*a* shown with dashed lines.

The position of the high voltage flexible hose 2 from FIG. 1 is shown here connected to the docking head and leading out (toward the right side in the diagram of FIGS. 3*c*, 4) under the insulation cover for connection to an applicator.

In the paint dosing apparatus, the dosing cylinders are moveable to and from the docking head as indicated by arrow M by an actuator means 13 of some sort. The docking head typically comprises a valve block or other valve means for routing paint and/or flushing solvent as desired to the spray head or applicator. Such a valve block is usually adapted for facilitating changes in paint colour, and usually has valve means for flushing separately each dosing cylinder-to-docking head connection point. The valve block usually also has various valves and conduits for conducting waste paint and/or flushing liquid away to a waste collection means.

The docking head is connected by a hose 2 to a spray gun or applicator. The hose is preferably made of insulating material and the outer surface of the hose 2 is covered in part by a conductive or non-insulating layer 3 which is connected to a ground 4. The conductive or non-insulating layer 3 may not extend for the whole length of the hose and may instead stop a predetermined distance away from one or both ends of the hose. The hose is preferably flexible and may be arranged over joints that move.

A paint application apparatus maintained in part at a high voltage comprising an insulation cover according to an embodiment of the invention is able to insulate the paint or fluid from the grounded surroundings without the cover becoming charged on the surface. Such a paint application apparatus may be arranged connected to a robot equipped with one or more applicators. One or more such paint application apparatus may be also be arranged mounted on a robot of the multi axis type. Such an insulation cover as described may also be used for paint application apparatus arranged to supply paint to applicators or spray heads arranged fitted on simpler machines than multi-axis robots, machines such as Cartesian robots, or reciprocating painting machines, side or top machines, or other machines that operate using only one or two degrees of freedom.

Figure 4:
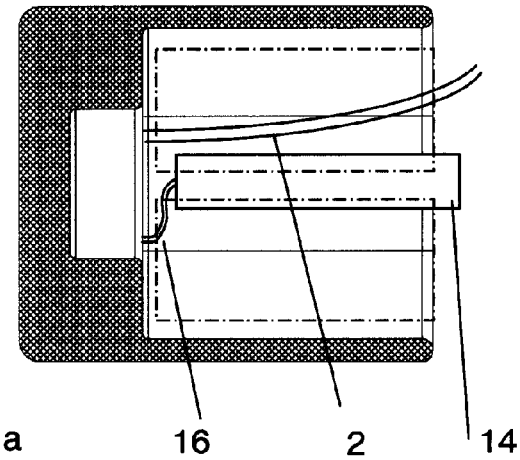
FIG. 4 shows a sectional view from the top of an insulating cover comprising a flushing device according to another embodiment of the invention.

FIG. 4 shows another embodiment of the invention in which a flushing reservoir is also arranged inside the insulation cover. The figure shows a cover 1 and a position of flushing reservoir 14 arranged inside. The flushing reservoir is preferably a substantially cylindrical container device for holding flushing fluid, which may also be connected by a supply line 16 to a connection point for flushing fluid comprised in the docking head. Such flushing fluid is used to clean supply lines, valves or applicators during a colour change or for other reasons. In particular such flushing fluid may be used to clean the docking valve for a dosing cylinder when the dosing cylinder is withdrawn from the docking head. Arranging the insulation cover to accommodate the flushing reservoir means that a relatively large volume of flushing fluid may be rapidly supplied to clean a docking valve or to flush after a colour change etc. as necessary, without compromising insulation shielding of the flushing fluid from the high voltage parts.

Figure 5:
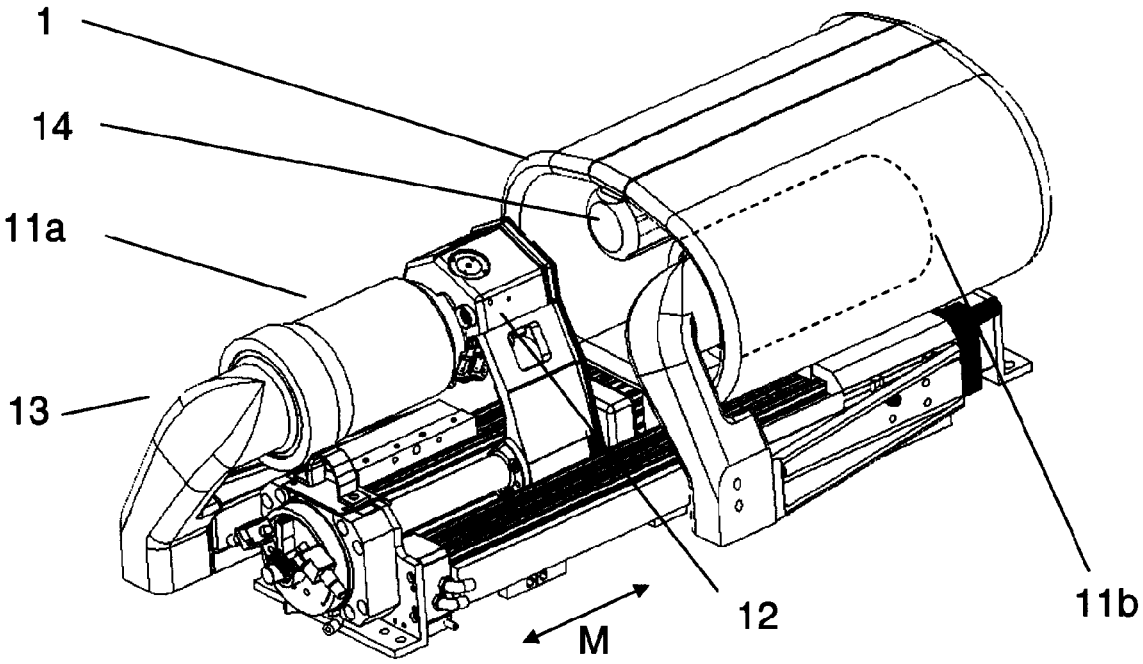
FIG. 5 shows a 3-D view of a dosing apparatus including the insulating cover and comprising a flushing device according to an embodiment of the invention.

FIG. 5 shows another view of an insulation cover embodiment with a flushing device. The figure shows the insulation cover 1*a* dosing cylinder 11*a* and second dosing cylinder lib, and a flushing reservoir 14. From this view it may be seen that one dosing cylinder 11*a* is withdrawn and arranged for filling at a moveable filling head 12. After filling, filling head 12 would move out of the way and dosing cylinder 11*a* be moved forward (right) in the direction M to dock at the docking head (not shown) beside a second dosing cylinder lib. A second dosing cylinder lib may be partly seen inside the insulation cover where the position is indicated with a dashed line. The flushing reservoir 14 is shown arranged in a position above that of where each of the dosing cylinders may be arranged when inside the insulation cover.

Figure 6:
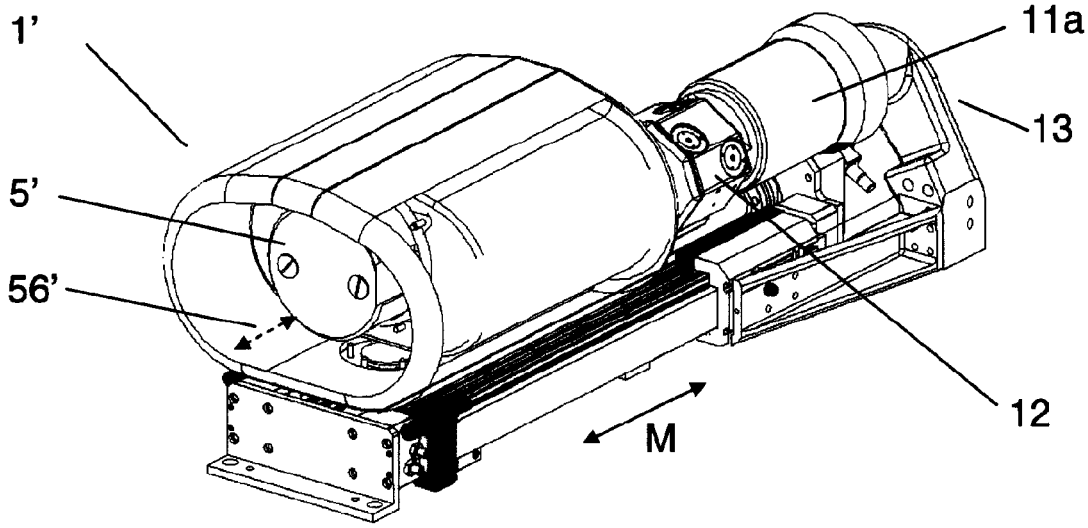
FIG. 6 shows a 3-D view of a dosing apparatus including the insulating cover according to another embodiment of the invention.

FIG. 6 shows a view of an insulation cover according to another embodiment of the invention. The figure also shows a 3-D view from the reverse side to the view of FIG. 5. The figure shows a dosing cylinder 11*a* outside the insulation cover held by an actuator arm 13. In this embodiment, the insulation cover 1' extends behind the docking head 5 as shown. The insulation cover extends beyond the back side of the docking head as indicated by arrow 56'.

It should be noted that while the above describes exemplifying embodiments of the invention, there are several variations and modifications which may be made to the disclosed solution without departing from the scope of the present invention as defined in the appended claims.

What is claimed is:

1. An insulation cover for use with a paint dosing apparatus maintained at a high voltage, that includes a docking head arranged to receive at least one container filled with paint for dosing to an applicator or gun, wherein the insulation cover surrounds the docking head at least in part and comprises a non-conductive material and a conductive layer partly covering an external surface of the non-conductive material of the insulation cover; and wherein the conductive layer is connected to a ground terminal.

2. An insulation cover according to claim 1, wherein the conductive layer covers the external surface of the non-conductive material of the insulation cover in the proximity of the docking head.

3. An insulation cover according to claim 2, wherein an internal surface of the insulation cover is covered in part by a conductive or non-insulating layer.

4. An insulation cover according to claim 3, wherein the internal surface of the insulation cover covered in part by a conductive or non-insulating layer is in the proximity of an aperture arranged to cooperate with the docking head.

5. An insulation cover according to claim 1, wherein the insulation cover encloses a docking head and a connection to one end of a flexible high voltage hose, wherein the other end of the flexible high voltage hose is connected to an applicator.

6. An insulation cover according to claim 1, wherein the insulation cover encloses a flushing device.

7. An insulation cover according to claim 6, wherein the insulation cover encloses a flushing reservoir arranged connectable to the docking head.

8. An insulation cover according to claim 1, wherein the insulation cover is formed so as to cover not only the docking head and dosing cylinders when connected to the docking head but the insulating cover also extends behind the docking head in a direction away from the dosing cylinders.

9. An insulation cover according to claim 1, wherein the paint dosing apparatus is arranged connected to a robot or other paint spraying apparatus.

10. An insulation cover according to claim 9, wherein the paint dosing apparatus is arranged mounted on a multi axis robot.

11. An insulation cover according to claim 9, wherein the paint dosing apparatus is arranged mounted on a paint spraying apparatus of the reciprocating machine type.

12. A paint dosing apparatus maintained at a high voltage, comprising:

a docking head;

an insulation cover at least partially surrounding the docking head, comprising a non-conductive material and a conductive layer partly covering the external surface of the non-conductive material of the insulation cover; and wherein the conductive layer is connected to a ground terminal.

13. An apparatus according to claim 12, wherein the internal surface of the insulation cover is covered in part by a conductive or non-insulating layer in the proximity of the docking head.

14. An apparatus according to claim 12, wherein the insulation cover is arranged to cover a first end of at least one flexible high voltage hose that is connected at one end to the docking head, where a second end is connected to an applicator.

15. An apparatus according to claim 14, wherein the insulation cover is arranged to cover one of a plurality of dosing cylinders, and means to connect different dosing cylinders to the docking head.

16. An apparatus according to claim 15, wherein the insulation cover is arranged to cover a flushing cylinder inside the insulation cover.

17. An apparatus according to claim 15, wherein the insulation cover encloses a flushing reservoir arranged connectable to the docking head for flushing a dosing cylinder-to-docking head connection valve filling the reservoir with flushing fluid.

18. An apparatus according to claim 15, wherein the insulation cover encloses a flushing reservoir arranged connectable to the docking head for filling the reservoir with flushing fluid via the docking head.

19. An apparatus according to claim 15, wherein the flushing reservoir is arranged suitably connected to the docking head to flush any from the list of: docking valve, paint supply conduit from docking valve to applicator, and applicator head.

20. An apparatus according to claim 12, further comprising at least one robot arranged and connected to the paint dosing apparatus maintained at a high voltage.

21. An apparatus according to claim 12, further comprising at least one robot arranged with the paint application apparatus maintained in part at a high voltage mounted on a robot arm.

22. An apparatus according to claim 20, wherein the paint dosing apparatus maintained at a high voltage is arranged on a reciprocating machine for painting in single axis direction or arranged for movement in two axes.

23. An apparatus according to claim 12, wherein the paint application apparatus maintained at a high voltage is arranged on a Cartesian robot for painting and movement in a single axis or two axes.

* * * * *